US005775522A

United States Patent [19]

Martin, Sr.

[11] Patent Number: 5,775,522

[45] Date of Patent: Jul. 7, 1998

[54] CARD DIVIDER AND HOLDER

[76] Inventor: Chester Martin, Sr., 201 N. State, Terril, Iowa 51364

[21] Appl. No.: 727,886

[22] Filed: Oct. 9, 1996

[51] Int. Cl.[6] ..... A47F 5/00

[52] U.S. Cl. ..... 211/184; 211/59.4; 206/455; 220/529; 220/530

[58] Field of Search ..... 211/184, 59.4; 229/120.07, 120.35; 206/455; 220/529, 530; 40/637, 640, 610; 108/60, 61

[56] References Cited

U.S. PATENT DOCUMENTS

| | | | |
|---|---|---|---|
| 691,628 | 1/1902 | Hoffman et al. . | |
| 901,069 | 10/1908 | Chelson et al. . | |
| 943,719 | 12/1909 | Vick | 211/184 X |
| 1,272,207 | 7/1918 | Hullen . | |
| 1,473,064 | 11/1923 | Vance . | |
| 1,675,269 | 6/1928 | Hine . | |
| 2,249,234 | 7/1941 | Srodulski . | |
| 2,280,371 | 4/1942 | Bishop . | |
| 2,532,600 | 12/1950 | Broersma . | |
| 3,185,307 | 5/1965 | Higgins . | |
| 3,241,683 | 3/1966 | Blodee . | |
| 3,339,746 | 9/1967 | McCabe | 211/184 X |
| 3,385,450 | 5/1968 | Nadler et al. | 211/184 X |
| 4,606,468 | 8/1986 | Parker et al. . | |
| 4,928,415 | 5/1990 | Walters | 40/610 |
| 5,458,434 | 10/1995 | Bent et al. | 40/610 X |

FOREIGN PATENT DOCUMENTS

| | | | |
|---|---|---|---|
| 978328 | 4/1951 | France | 220/529 |
| 185901 | 2/1906 | Germany | 220/529 |
| 288447 | 5/1953 | Switzerland | 220/529 |
| 861645 | 2/1961 | United Kingdom | 211/184 |
| 901114 | 7/1962 | United Kingdom | 220/529 |

*Primary Examiner*—Blair Johnson
*Attorney, Agent, or Firm*—Zarley, McKee, Thomte, Voorhees, & Sease

[57] ABSTRACT

A divider and holder of the present invention is adapted to support and divide a number of articles such as cards within a rectangular container. The divider and holder includes a pair of flat surfaces connected by hinge portions. By bending the flat portions, a V-shaped member is formed which can be inserted between the side walls of the container, holding and dividing articles within the container. The bottom edges of the divider include a number of pointed protrusions which help prevent the divider from sliding along the length of the container.

3 Claims, 2 Drawing Sheets

CARD DIVIDER AND HOLDER

BACKGROUND OF THE INVENTION

1. Field of the Invention

The present invention relates to collections of cards and other flat articles. More particularly, though not exclusively, the present invention relates to an apparatus and method for dividing and holding articles.

2. Problems in the Art

In hobbies such as sports card collecting, it is common to store the cards in boxes. It is also common to separate or sort cards based on the year they were printed or by value. Various systems have been used in the prior art to separate and hold sports cards. For example, a group of cards are commonly held together with a rubber band. While this works well, the top and bottom cards are commonly damaged over time by the rubber bands, decreasing their value. To view the cards, it is also necessary to remove the rubber band from the cards. In addition, even while cards can be held together with rubber bands, they can still fall over within a box or other container. Other systems include using index cards with tabs to separate the sports cards. While this separates the sports cards, it does not hold the cards upright which results in cards scattered throughout the container.

Therefore, a need can be seen for a system for separating and holding cards or other articles. There is also a need for such a system which is flexible and easily adjustable for when new articles are acquired.

FEATURES OF THE INVENTION

A general feature of the present invention is the provision of an apparatus and method for dividing and holding articles which overcomes problems found in the prior art.

A further feature of the present invention is the provision of an apparatus and method for separating cards or other articles using a V-shaped member which is disposed between the sides of a container and is abutted against the articles, dividing and supporting the articles.

Further features, objects and advantages of the present invention include:

An apparatus and method for dividing and storing articles which includes two flat surfaces hinged together and folded to a V-shaped configuration to fit within the container.

An apparatus and method for dividing and holding articles which uses a divider having points formed on the edges of the divider for engaging the divider with the container.

An apparatus and method for dividing and holding articles which uses a divider having two surfaces coupled together with a unique, single-piece hinge forming a V-shaped member.

An apparatus and method for dividing and holding articles within a container which holds the articles in place while supporting the lid of the container.

These as well as other objects, features and advantages of the present invention will become apparent from the following specification and claims.

SUMMARY OF THE INVENTION

The article divider and holder of the present invention is used by card collectors or users of other articles to separate and hold articles within a container. The invention is comprised of first and second surfaces having top, bottom and side edges. The top edges are movably coupled together by a hinge and are normally biased toward a coplanar orientation. By bending the divider at the hinge, the two surfaces can be placed within a container with the bottom edges abutting the opposing sides of the container. The bottom edges of the surfaces may optionally include a plurality of points for engaging the container to prevent the divider and holder from sliding along the length of the container. The hinge may optionally be formed of the same material as the two surfaces. The hinge may have a smaller thickness than the remaining portions of the divider.

DETAILED DESCRIPTION OF THE PREFERRED EMBODIMENT

The present invention will be described as it applies to its preferred embodiment. It is not intended that the present invention be limited to the described embodiment. It is intended that the invention cover all alternatives, modifications, and equivalences which may be included within the spirit and scope of the invention.

Figure 1:
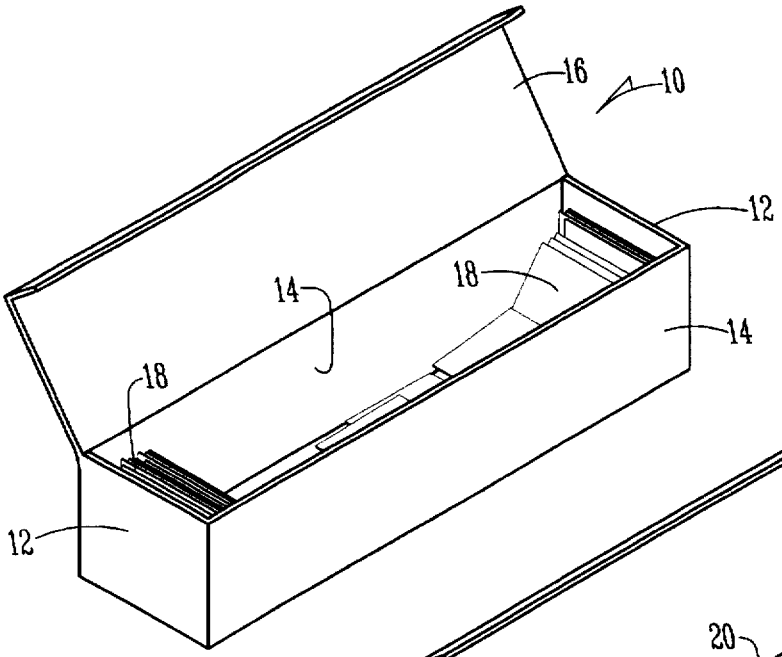
FIG. 1 is an isometric view of a sports card container holding a number of sports cards without the benefit of the present invention.

FIG. 1 shows a prior art system for storing sports cards. As shown in FIG. 1, an elongated cardboard box 10 is provided having a bottom, opposing ends 12, opposing sides 14 and a lid 16. As shown, the box is generally shaped like the sports cards which are stored within the box 10. Also shown in FIG. 1 are a number of sports cards 18 which become scattered and mixed up within the box 10.

Figure 2:
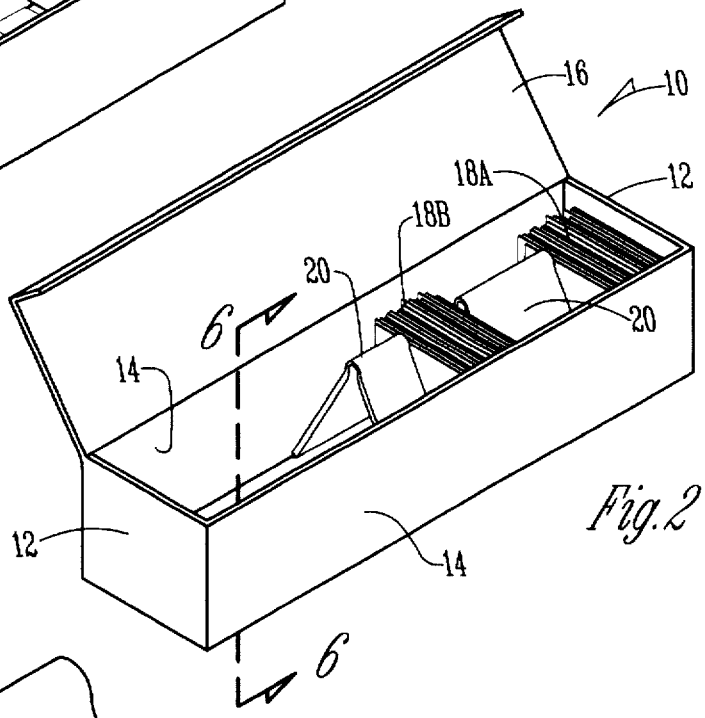
FIG. 2 is a sports card container containing two sets of cards held and divided by two devices of the present invention.

FIG. 2 shows the box 10 shown in FIG. 1 with the cards 18 but with the use of two devices 20 of the present invention. As shown in FIG. 2, a first set of cards 18A is abutted against the end 12 of the box 10 and also against the device 20. A second set of cards 18B is positioned between the two devices 20. In this way, the cards are held in the position shown in FIG. 2 and are also separated into two groups. Even if the box 10 is tilted, the devices 20 will prevent the cards from sliding within the box 10.

Figure 3:
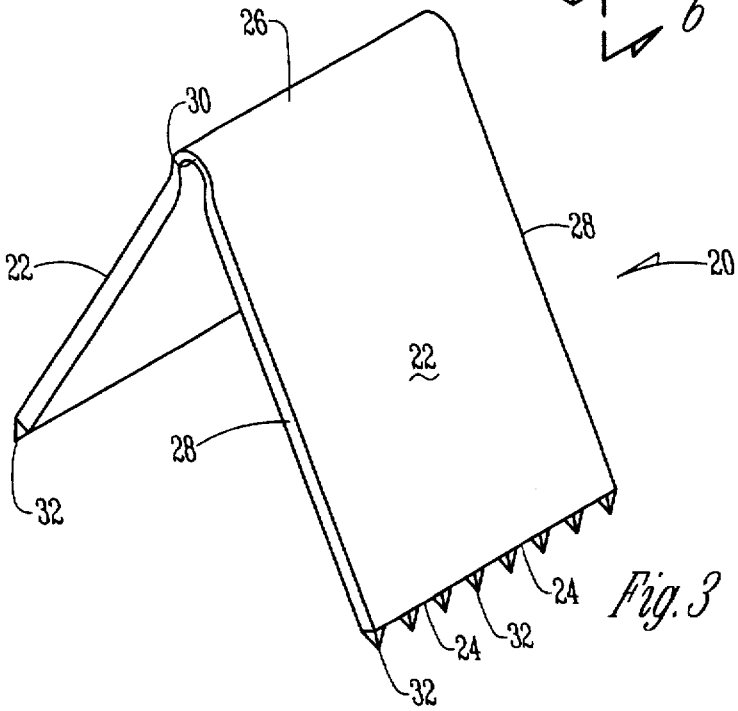
FIG. 3 is an isometric view of the present invention.

FIG. 3 is an isometric view of the device 20 of the present invention. As shown, the device 20 is comprised of a pair of planar surfaces 22 each having a bottom edge 24, a top edge 26 and opposing side edges 28. The surfaces 22 are joined along the top edges 26 by a hinge 30. Spaced along the bottom edges 24 are a number of pointed protrusions 32 which extend from the bottom edges 24 and are adapted to engage the box 10 so that the device 20 is less likely to slide laterally within the box 10.

Figure 4:
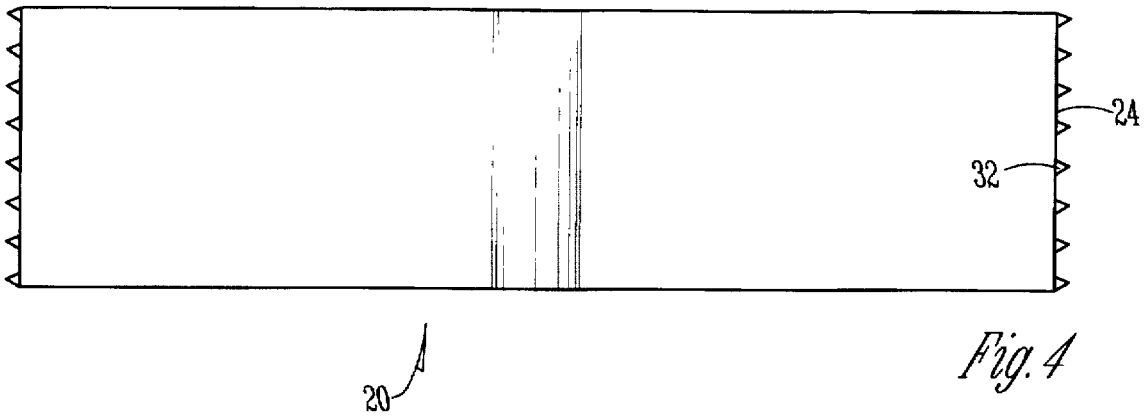
FIG. 4 is a top view of the present invention in a flat orientation.
Figure 5:
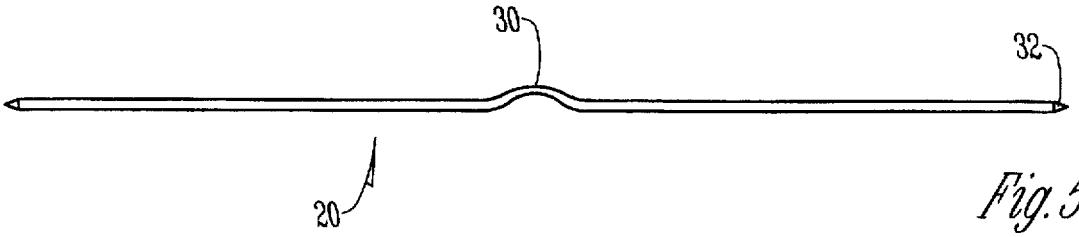
FIG. 5 is a side view of the view shown in FIG. 4.
Figure 6:
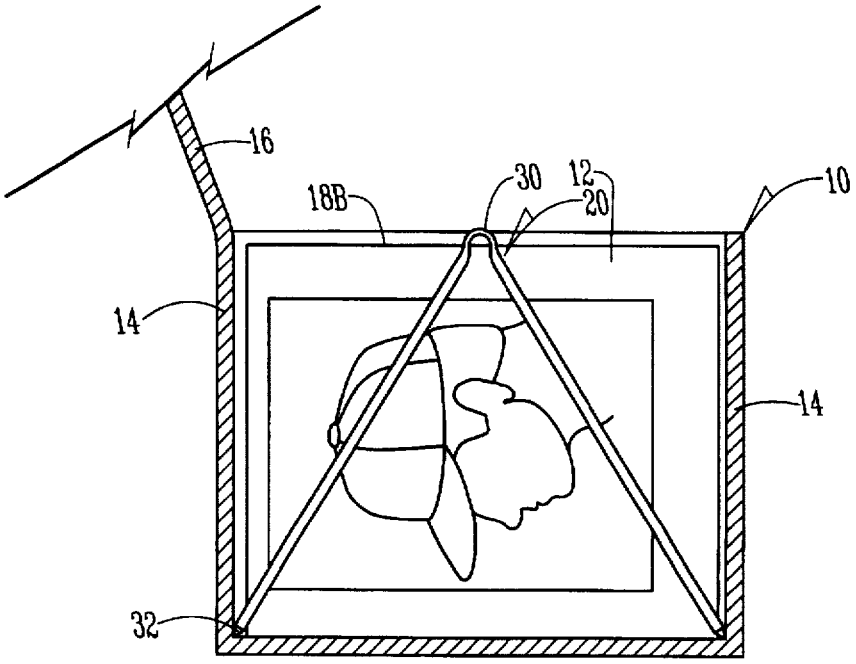
FIG. 6 is a cross-sectional view taken along lines 6-6 of FIG. 2 showing a side view of the present invention.

FIGS. 4 and 5 are top and side views of the device 20 in a flattened position. The device 20 is normally biased toward the flat position shown in FIGS. 4 and 5. As shown in FIG. 5, the hinge 30 is formed between the planar surfaces 22 and is made from the same material as the two surfaces 22. As shown in FIG. 5, the thickness of the hinge is approximately half of the thickness of the surfaces 22. This allows the hinge 30 to bend more easily and also causes the device 20 to bend at the hinge rather than at a point along one of the flat surfaces 22. The hinge 30 is comprised of a smooth curve which is raised slightly from the planar surfaces 22 (FIG. 5). In order to use the device 20, the device is bent from the flat position shown in FIGS. 4 and 5 to the bent position shown in FIG. 3. The device can then be placed within the box 10 as shown in FIG. 6. Since the device 20 is biased toward the flat position shown in FIG. 5, when the device is bent as shown in FIG. 6, the planar surfaces 22 are biased outward so that the bottom edges 24 press against the sides 14 of the box 10. This holds the device 20 in place. To further secure the device in place, the points 32 press against the box 10 to help prevent the device 20 from sliding within the box 10.

The present invention operates as follows. Before or after placing cards 18 within the box 10, the user will bend the device 20 so that the device moves from the flat position shown in FIG. 5 to the bent position shown in FIG. 6. The bent, V-shaped device 20 can then be inserted between the side walls 14 of the box 10. When the user releases the device 20, the bottom edges 24 of the device 20 as well as the points 32 press against the sides 14 of the box 10 holding the device 20 in place. By pressing on the planar surfaces 22 of the device 20, the user can easily slide the device 20 back and forth within the box in order to abut one or more cards 18 which are stacked in the box 10 as shown in FIG. 2. One or more devices can be used at once. When the dividers and holders are not in use, they may be stored in the flattened position shown in FIGS. 4 and 5.

By carefully choosing the length of the planar surfaces 22, the present invention can also enhance the strength of the box 10. As shown in FIG. 6, the height of the device 20 is approximately the same as the height of the side walls 14 of the box. Therefore, when the lid 16 is in the closed position (not shown) the device 20 will support the lid 16 of box 10 in the middle the box 10. This helps to strengthen the box and prevent damage to the cards 18.

While the present invention has been shown for use with sports cards such as baseball cards, football cards, hockey cards, etc., the present invention can be used for dividing or holding a number of articles including compact discs, paper, cassette tapes, video tapes, etc.

While the dimensions and materials used with the present invention can vary, the preferred dimensions are as follows. The planar surfaces 22 are preferably 1/16th of an inch thick while the hinge 30 tapers down to approximately 1/32nd of an inch thick. The points 32 are preferably spaced about a ¼ of an inch apart along the entire length of the bottom edges 24. The width of the device can vary depending on the desired use, although 1¾ inches is a preferred size. The width of the hinge 30 shown in FIG. 5 is preferably about ½ inch. The entire length of the device in the flattened position shown in FIG. 5 is approximately 6½ inches. The device 20 is preferably made from a single piece of flexible plastic, although other materials could be used.

The preferred embodiment of the present invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention as further defined in the following claims.

What is claimed is:

1. A method of separating and supporting articles within a rectangular container having a bottom and opposing sides comprising the steps of:

placing a plurality of articles within the container in an upright position and disposed perpendicular to the opposing sides of the container;

providing a substantially flat rectangular body having opposing first and second edges;

forming a hinge between the first and second edges defining first and second portions of the rectangular body, with one portion on each side of the hinge;

bending the rectangular body about the hinge with the first and second portions of the rectangular body each extending at an angle toward the hinge to form a V-shaped member; and placing the V-shaped member within the container with the first and second edges biased against the opposing sides of the container so that the V-shaped member abuts at least one of the articles.

2. The method of claim 1 further comprising the steps of:

placing a plurality of additional articles within the container in an upright position and disposed perpendicular to the opposing sides of the container, and abutting the V-shaped member; and placing a second V-shaped member within the container so that the second V-shaped member abuts the plurality of additional articles.

3. The method of claim 2 further comprising the step of forming a plurality of points along the first and second edges of the rectangular body.

* * * * *